US011164490B2

(12) United States Patent
Weis

(10) Patent No.: US 11,164,490 B2
(45) Date of Patent: Nov. 2, 2021

(54) SIGN WAVING MACHINE PLATFORM

(71) Applicant: Roy John Weis, McMinnville, OR (US)

(72) Inventor: Roy John Weis, McMinnville, OR (US)

( * ) Notice: Subject to any disclaimer, the term of this patent is extended or adjusted under 35 U.S.C. 154(b) by 47 days.

(21) Appl. No.: 16/806,514

(22) Filed: Mar. 2, 2020

(65) Prior Publication Data

US 2021/0287578 A1 Sep. 16, 2021

(51) Int. Cl.

*G09F 11/02* (2006.01)
*G09F 15/00* (2006.01)
*G09F 19/02* (2006.01)

(52) U.S. Cl.

CPC ..... *G09F 15/0087* (2013.01); *G09F 19/02* (2013.01); *G09F 2015/0093* (2013.01)

(58) Field of Classification Search

CPC ..... G09F 15/0087; G09F 2015/0093; G09F 19/02
USPC ..... 248/158; 40/493, 473, 470
See application file for complete search history.

(56) References Cited

U.S. PATENT DOCUMENTS 5,203,743 A * 4/1993 Hou ..... A63H 13/20 472/12
5,986,189 A * 11/1999 Yang ..... A63H 13/20 40/415
6,775,938 B2 * 8/2004 Lanci ..... G09F 19/02 40/473

* cited by examiner

*Primary Examiner* — Todd M Epps

(57) ABSTRACT

A sign waving machine platform for street side promotions that incorporates a base frame, a sign waving apparatus plus an upper web to attach accessories including mannequins and electric signs. The sign waving apparatus includes a motor housing, battery, electric motor and bracket assembly that couples the motor drive shaft to a sign frame which moves relative to the housing as the motor drive shaft rotates. Signs can be attached to all sides of the sign frame. The platform attaches at the top only to posts, carts and other so it can freely swing in many directions with the wind. This rugged, lightweight platform has a primary structure made from 2 aluminum tubes; one slides inside the other and telescopes. Fastening occurs using thumb screws attached to the outer tubes and joints that when twisted, pinches the inside interconnecting tubes. The platform stretches in many directions providing numerous configurations.

20 Claims, 4 Drawing Sheets

SIGN WAVING MACHINE PLATFORM

FIELD OF THE INVENTION

This present invention relates generally to a mechanical sign waving machine platform for street side advertising and promotional purposes.

BACKGROUND

Businesses, schools and other entities have long employed the use of signs and other media to attract, inform, and/or direct customers, such as by advertising a special promotion or event, providing directions to a specific location, and so forth. One popular technique is to utilize or employ individuals to hold signs outside or otherwise near an entities' location to better engage passersby, such as stationing a human sign holder on the side of a busy street in order to draw the attention of motorists. It is thought that a sign that is displayed by a human sign holder is better at attracting and maintaining attention, as compared to the static nature of fixed signs, because the individual holding a hand-held sign may twirl, wave, or otherwise move the sign around, interact with passersby by waving or gesturing, dress in a costume or otherwise add a performance element to the display of the sign, and so forth.

This technique suffers from many drawbacks, some of which are related to sign visibility. For example, the elevation at which a hand-held sign may be displayed is generally limited to how high a person can raise the sign over his or her head, which may limit the visibility range of the sign. Also, a hand-held sign should be large enough to display information effectively, but if too large, the sign may be too cumbersome; a user may not have a hand free to wave to traffic. Further, large signs may block the individual holding the sign from view reducing the interactive impact with motorists and passersby. User fatigue from standing and holding a sign for long periods of time is a major issue, especially if the individual is expending energy to move him or herself, and/or the sign, around. Also, a major issue is the labor cost to employ human sign holders.

To address these limitations, several entities have developed a mechanical sign waving machine to replace human sign holders. These machines typically have their sign waving apparatus mounted on top of a base with wheels. To avoid tipping over, level ground is required. Additionally, most machines can easily blow over on windy days limiting the elevation at which their signs can be displayed. These machines can be heavy especially at their bases making it difficult for users to physically carry and handle. Also, most of these sign waving machines do not have the capability to attach accessories such as mannequins, flags, and extra signs including electrical versions.

Therefore, what is needed is a lightweight, rugged, rust proof, sign waving machine platform that includes a sign waving apparatus plus the capability to attach media accessories such as mannequins, flags and extra signs, all of which as a single unit can freely swing with the wind.

SUMMARY

Various embodiments of a sign waving machine platform for store front and street side promotions are disclosed herein. This platform is made from aluminum tubes that support a sign waving apparatus plus an upper web for hanging optional media accessories. The basic embodiment has a vertical spine, consisting of two interconnected aluminum tubing members, which supports the upper web and at the bottom of the spine attaches to a motor housing assembly that encloses a motor that connects to a sign waving frame. The motor housing fits inside the sign waving frame which resembles a box-shaped truss structure. A variety of signs can be attached to all sides of the sign waving frame allowing viewing from many traffic directions. The adjustable upper web provides the mounting sites for accessories such as additional signs, advertising devices, mannequins, and flags to complement those signs attached to the sign waving apparatus.

A battery which can lie on the ground or elsewhere, provides the power to the low speed electric 12-volt gear head motor that is capable of operating at multiple speeds in both clockwise and anti-clockwise directions. The motor's drive shaft is partially exposed outside of the housing and is coupled to an adjustable drive bracket which connects to a bearing assembly attached to the sign waving frame. It is the rotation of the motor drive shaft and the drive bracket that causes movement of the sign waving frame relative to the motor housing. Most of the weight of the sign waving frame and attached signs is supported by support brackets which minimizes the overhung load on the motor drive shaft. These support brackets are mounted to the housing and are connected to other bearing assemblies mounted to the sign waving frame. These support brackets are freewheeling and move in tandem with the drive bracket. The drive and support brackets are all adjustable providing a wide variety of sign motions including a sideways swinging motion and a vertical rocking motion.

The platform is loosely attached at the top to user-furnished structures such as posts, racks or carts to provide a free-swinging motion to counteract the effects of wind. Connectors include zip ties, cords and rope that can be locally purchased in stores. The entire platform plus attachments swing in unison like one large pendulum. Because the spine and motor box set inside the sign waving frame, any signs attached to the sign waving frame may overlap any media hanging from the upper web without interfering in sign movement. This feature can provide a unique visual effect of overlapping dueling messaging. Because all items and loads are hung, the possibility of tipping over is minimal unlike ground based competitive versions that need to sit on level surfaces and can tip over possibly damaging their sign waving apparatuses.

The platform's core structural brace members consist of 2 smaller aluminum insert tubes that slide inside a larger aluminum host tube. Attached to both ends of the host tube are thumb screws and when twisted, press against and pinch the insert tubes to produce a snug, secure fasten. All connecting joints are made from the same large host tube and include thumb screws for fastening. To make more rugged, some slop or spacing between the tubes is designed in, so if dirty or damaged, the insert tubes may still slide and still be snuggly fastened using the thumb screws.

All the brace members can telescope or stretch up to the point where the not-to-exceed markings stamped onto the insert tubes, have become visible. If stretched beyond the markings, the insert tube may slide too far and the thumb screw could miss it. The overall length of the brace members can also be changed by connecting additional host and insert tubes and by providing tubes of different lengths, such as in 1foot increments. Because of this structural versatility, the spine, upper web and sign waving frame has numerous configurations and can substantially stretch or telescope in many directions to accommodate a variety of drive motor configurations and sign sizes. This platform can easily be adapted to support other sign waving apparatuses including competitive versions that sit on top of the ground; basically hanging them off the ground so that they can swing with the wind.

The platform, being made from aluminum tubes, is sturdy, rugged, rust proof, and lightweight. Depending on the configuration and components used, the platform has a display capacity of about 300 pounds; 400 and more if reinforced components are used. It can easily be disassembled for storage by simply un-twisting the thumb screws. In some embodiments, other fastening mechanisms or combinations thereof may be employed including snap buttons, and bolts with nuts. In other embodiments, alternate tube sizes, wall thicknesses, and tube dimensions may be optionally used. In some embodiments, other materials such as composites and plastics might be used instead of aluminum. In other embodiments, the platform's components and members may be coated with a reflective paint or powder coat where the reflection and bright colors can help gain the attention of passersby.

BRIEF DESCRIPTION OF THE DRAWINGS

The concepts, features, methods, and component configurations briefly described above are clarified with reference to the accompanying drawings and following detailed descriptions. Skilled artisans will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the inventions.

DETAILED DESCRIPTION OF THE DRAWINGS

In the following paragraphs, the present embodiments will be described in detail by way of example with reference to the attached drawings. Throughout this description, the preferred embodiment and examples shown should be considered as exemplars, rather than as limitations on the present embodiments.

Figure 1:
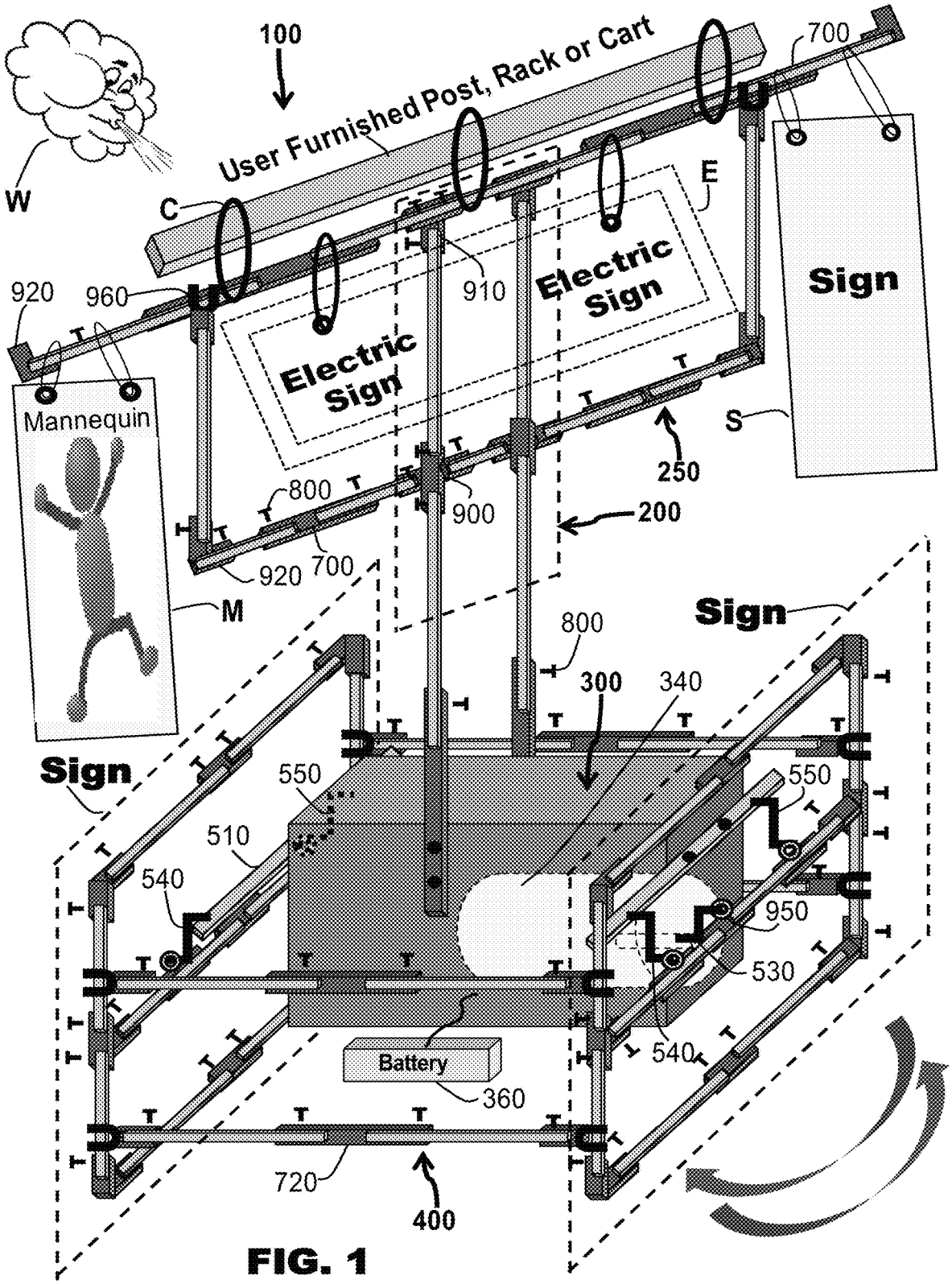
FIG. 1 is an elevation view of an example embodiment of the sign waving machine platform that stretches in many directions and consists of telescoping aluminum tubes that loosely attaches at the top to user-furnished posts, carts and so forth, and supports a sign waving apparatus at the bottom and an optional upper web at the top to mount accessories such as mannequins and electric signs.

FIG. 1 illustrates an embodiment of the sign waving machine platform 100 where a vertical spine 200, consisting of two interconnected aluminum tubing members, supports an upper web 250 and attaches at the bottom of the spine 200 to a motor housing assembly 300 enclosing a motor 340 that connects to sign waving frame 400. Motor 340's drive shaft connects to one side of drive bracket 530 with the other side of bracket 530 connecting to bearing assembly 950 mounted to sign frame 400. Sign waving frame 400 resembles a box-shaped truss structure that surrounds motor housing assembly 300. A variety of signs can be attached to all sides of sign waving frame 400 allowing viewing from many traffic directions. The 12V DC gear head motor 340 can operate at multiple speeds in both clockwise and counter-clockwise directions. Motor 340 provides the torque that causes movement of the sign waving frame 400 relative to motor housing assembly 300. A battery 360 which can lie on the ground or elsewhere provides the power to motor 340.

Support brackets 540 and 550 mounted to housing assembly 300 are likewise connected to other bearing assemblies 950 mounted to sign waving frame 400. These support brackets 540 and 550 are free wheeling and move in tandem with drive bracket 530. Most of the combined weight of sign frame 400 and its attached signs are supported by support brackets 540 and 550. The overhung weight load on drive bracket 530 is minimal. All the support and drive brackets are adjustable providing a wide variety of sign motions including a sideways swinging motion and a vertical rocking motion.

Upper web 250 provides additional mounting sites for accessories such as electric signs E, mannequins M, and other signs S to complement those signs attached to sign waving frame 400. Using connectors C, spine 200 and web 250 are loosely attached at the top to user-furnished structures such as posts, racks or carts. These attachments provide a free-swinging motion in many directions to counteract the effects of wind W. Because all loads are hung, the possibility of tipping over is minimal unlike competitive versions that sit on the ground requiring a bottom-heavy counterweight arrangement plus level surface; they can still tip over possibly damaging their sign waving apparatuses.

The core structural methodology for platform 100 is based around 2 aluminum tubes; one slides inside the other allowing spine 200, upper web 250 and sign waving frame 400 to stretch or telescope in many directions. Thumb screws 800 are attached to all the connecting joints and are used as an easy-to-use secure fastening mechanism. Spine 200, upper web 250 and sign waving frame 400 have numerous configurations depending on the combination of joints, tube lengths and telescoping. Because of this structural versatility, platform 100 can easily be adapted to support other sign waving apparatuses, basically elevating them off the ground and switching them to a hanging mode that swings. In other embodiments, different motors and sign frame coupling mechanisms such as pins, can easily be attached to sign waving frame 400.

Figure 2A:
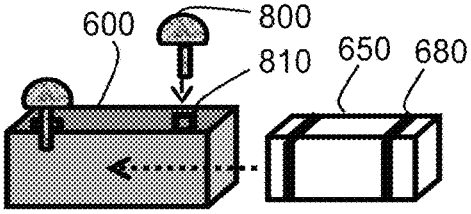
FIG. 2A illustrates the two types of tubes used in the FIG. 1 platform and the thumb screw fastening mechanism. Also shown are the "not-to-exceed" markings when telescoping or stretching the tubes.
Figure 2B:
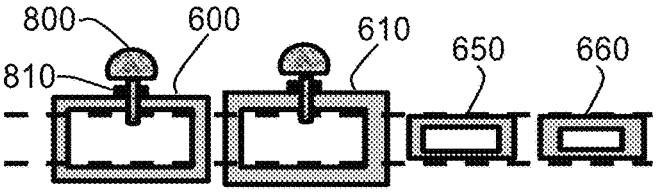
FIG. 2B is a side view of the 2 tubes shown in FIG. 2A plus optional heftier tubes with a thicker tube wall.

FIGS. 2A and 2B illustrate the two sizes of aluminum tubes used, the thumb screw fastening mechanism and the "not to exceed" markings when assembling. The smaller insert tube 650 slides inside the larger host tube 600. An aluminum nut 810 is welded to both ends of host tube 600 plus all the connecting joints shown in FIGS. 4 and 5. These nuts 810 are centered on a hole (not shown) into which is received a threaded thumb screw 800 or fin bolt. As the thumb screw 800 is twisted, it presses against and pinches insert tube 650. This pinching action provides a secure and snug, fastening mechanism. The pinching positions are continuous providing a wide range of telescoping. Embedded on both ends of insert tube 650 are "not-to-exceed" telescoping markings 680. If during assembly of platform 100 a marking 680 becomes visible, it informs the user not to stretch or telescope any further. If stretched beyond the markings, the insert tube 650 may have slid too far and the thumb screw could miss it. All thumb screws 800 and corresponding nuts 810 are located 1 inch from the end of host tube 600 and every connecting joint's branches. The 680 markings are located 2 inches from the ends of insert tube 650. The net effect is a 1-inch overlap buffer is created for thumb screw engagement. In some embodiments, other fastening mechanisms may be used including snap buttons, bolts with nuts, and combinations thereof.

Figure 3A:
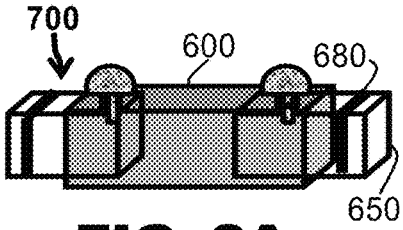
FIG. 3A illustrates the core tubing assembly that is used in the platform shown in FIG. 1.

FIG. 2B is a side view of the aluminum tubes 600 and 650 shown in FIG. 2A. The larger host tube 600 has a rectangular cross section of 1"×1.5" with a wall thickness of 0.045". Host tube 600 is also used in fabricating all the connecting joints. The smaller insert tube 650 has a rectangular cross section of 0.87"×1.37" and a wall thickness of 0.045". The combined effective wall thickness and associated strength is essentially doubled to 0.090" when tube assembly 700 in FIG. 3A is fully compressed. In other embodiments, the tube strength can be further increased by using tubes with a heftier wall thickness. As shown in FIG. 2B, tube 610 with a thicker wall, substitutes for host tube 600 while tube 660 with a thicker wall, substitutes for insert tube 650.

Insert tube 650 easily slides inside host tube 600 and all the joints. As illustrated by the dashed lines in FIG. 2B, there is some designed in slop or space between tubes 600 and 650 so if any become dirty or damaged, insert tube 650 can still slide and be snuggly fastened to host tube 600 using the thumb screw mechanism. In some embodiments, other materials such as composites and plastics might be used instead of aluminum. In other embodiments, the aluminum tube sizes, dimensions, and wall thickness may change but the concept of one tube sliding inside the other remains the same.

Figure 3B:
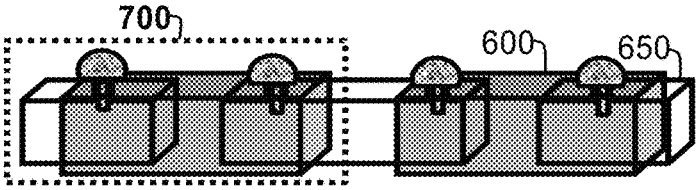
FIG. 3B illustrates connecting additional tubes to the core tube assembly in FIG. 3A to form a much larger brace member.

Shown in FIG. 3A is core tube assembly 700 which can be used in all the members in spine 200, upper web 250 and sign waving frame 400. Assembly 700 is comprised of one host tube 600 and two insert tubes 650 that protrude from both ends of host tube 600. As shown in FIG. 3B, these protruding insert tubes 650 can then interconnect with additional tubes 600 and 650 to form much larger members. In the basic embodiment, both tubes 600 and 650 will come in multiple lengths and multiple quantities with all included in a customer kit. This combination of tube lengths and quantities plus the telescoping capabilities provides an extensive range of platform 100 configurations. In other embodiments, different tube lengths and quantities can be offered for tubes 600 and 650.

Figure 4:
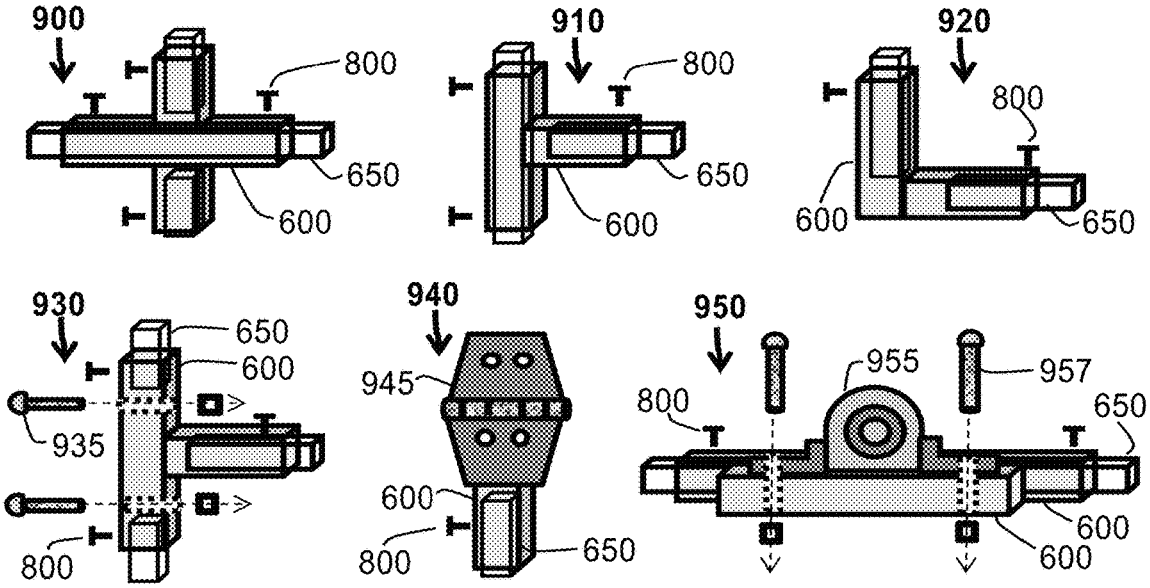
FIG. 4 is oblique views of 6 connecting joints used in the FIG. 1 platform.

FIG. 4 is oblique views of 6 connecting joints used in the FIG. 1 platform. These joints are fabricated from larger host tube 600 through which smaller insert tubes 650 slide within. Thumb screws 800 attached to these joints, provide a snug, secure fasten. Cross joint 900 and joint 910 are used for multiple extensions in spine 200, upper web 250 and sign waving frame 400. Elbow 920 is used to square up several configurations and to help prevent supported items from sliding off any overhanging members. Joint 930 is a bolt on arrangement used as an optional substitute for joint 910. As a substitute for connectors C, hinge joint 940 can be optionally used to connect platform 100 to user-furnished structures such as posts, racks or carts. One end of hinge 945 is bolted to host tube 600 and the other end to the user structure. This hinge arrangement limits swinging of platform 100 to one back and forth direction only.

Bearing joint 950 is used to connect drive bracket 530 and support brackets 540 and 550 to sign waving frame 400. Bearing joint 950 consists of a front and rear host tubes 600 welded together. Bearing 955 is bolted to the front-host tube 600 using bolt and lock nut 957. The rear host tube 600 is used to fasten joint 950 to sign waving frame 400. The insert tubes 650 in sign waving frame 400 slide inside joint 950's rear host tube 600 allowing joint 950 to freely slide and then be securely fastened using the thumb screws on joint 950's rear host tube 600.

Figure 5:
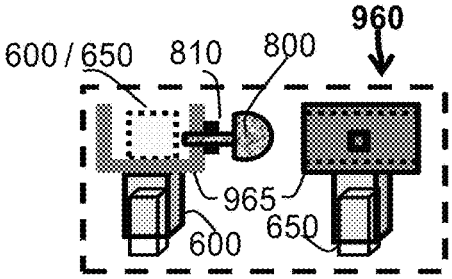
FIG. 5 shows an oblique view plus side view of the "U" joints that are used in the FIG. 1 platform.
Figure 6:
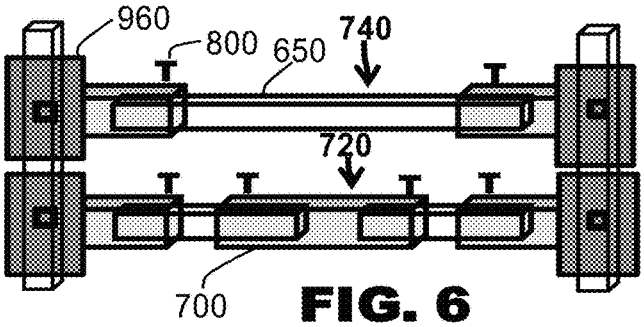
FIG. 6 is oblique views of 2 braces incorporating "U" joints that are used in the FIG. 1 platform.

As shown in FIG. 5, "U" joint 960 is made from a 3-inch-long aluminum channel 965 that is welded to host tube 600. Channel 965 has a 2-inch by 2-inch cross section. Tubes 600 and 650 sit inside channel 965 and are fastened using thumb screw 800 attached to channel 965. As shown in FIG. 1, "U" joint 960 can be used on top of upper web 250. As shown in FIG. 6, "U" joint 960 is also used in cross braces 720 and 740. Brace 740 consists of 2"U" joints 960 that are connected by a single insert tube 650. The host tube 600 in joint 960 provides some space for insert tube 650 to be compressed allowing brace 740 to be easily clamped to other tubes. Insert tube 650 can then be subsequently stretched for firm fastening by thumb screws 800. Cross brace 720 consists of 2"U" joints 960 that are connected by core tube assembly 700 shown in FIG. 3A.

Figure 7:
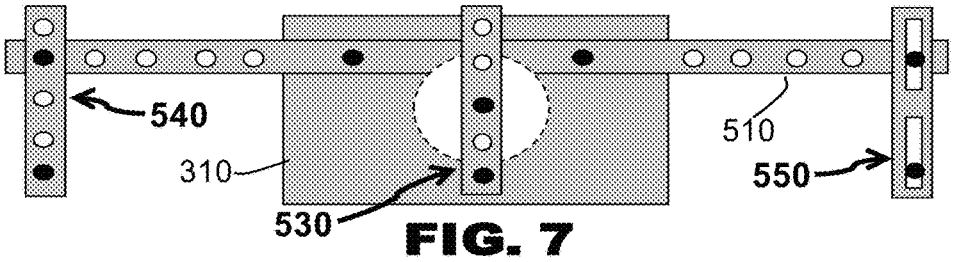
FIG. 7 is a side view of the motor box assembly shown in FIG. 8.
Figure 8:
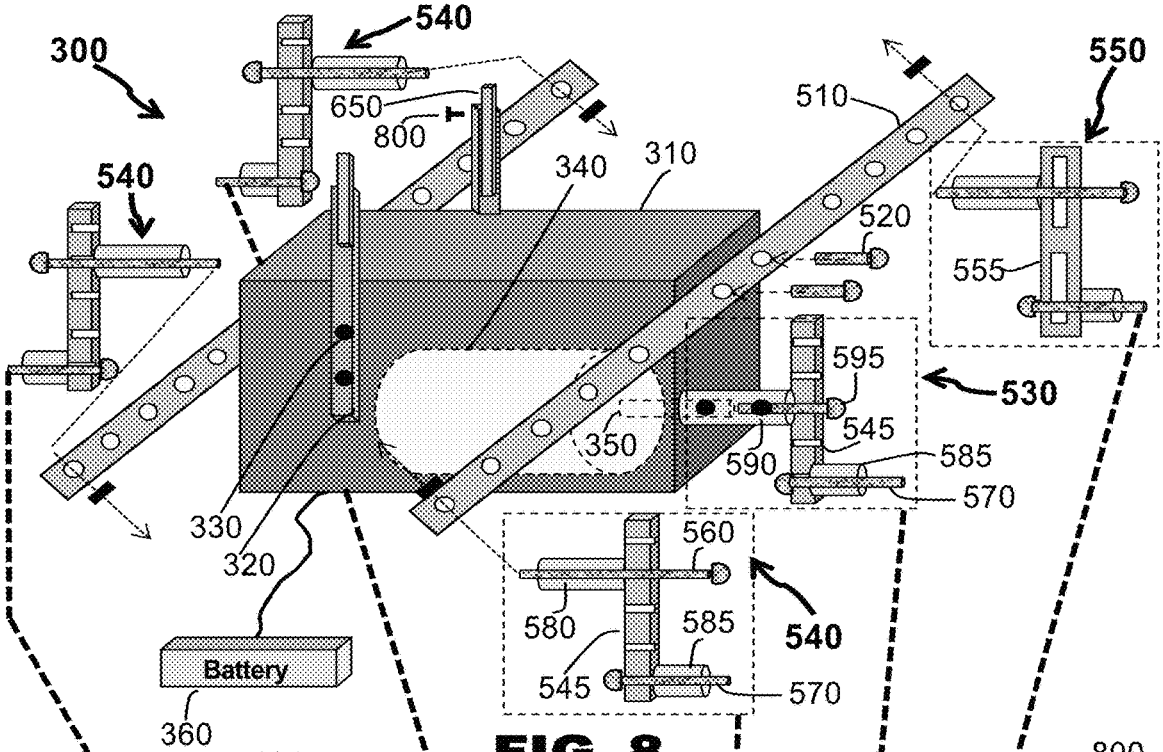
FIG. 8 is an exploded diagonal view of the sign waving machine's motor box assembly that fits inside and attaches to the sign waving frame shown in FIG. 9.
Figure 9:
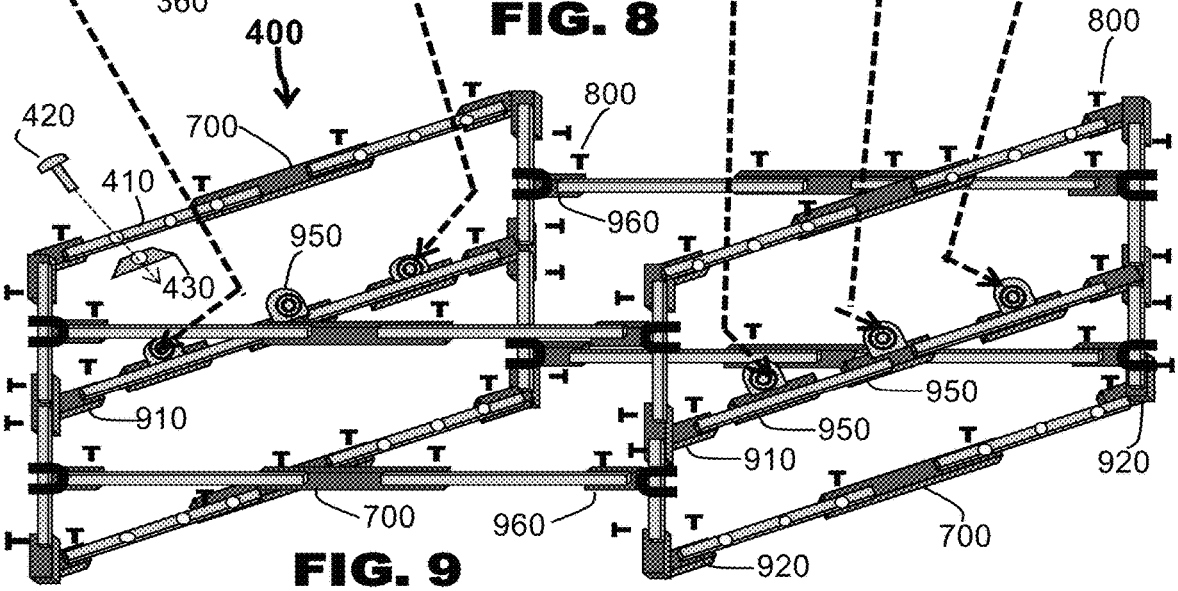
FIG. 9 is an expanded view of the sign waving frame that supports the signs, and which attaches to the drive bracket and support brackets of the motor box assembly shown in FIG. 8.

FIGS. 7, 8 and 9 are exploded elevation views of motor box assembly 300 and sign waving frame 400. FIG. 7 is a side view of motor box assembly 300. FIG. 8 is an exploded diagonal view of motor box assembly 300. Tubes 320 are made from host tube 600 and have 2 drilled holes for fastening to motor box 310 using bolt and lock nut 330. These tubes 320 then connect to the insert tubes 650 protruding from spine 200 and are fastened to spine 200 using the thumb screws 800 attached to tubes 320. Motor 340 is bolted to the inside of motor box 310 with the motor's electrical wires connecting to a 12-volt battery 360 that lies on the ground or elsewhere which provides power to motor 340.

Motor drive shaft 350 protrudes from box 310 and is connected to drive bracket 530. Within bracket 530, shaft coupler 590 and bolt 595 fasten motor drive shaft 350 to one end of sleeve 545. The other end of sleeve 545 is fastened to bearing assembly 950, shown in FIG. 4, using spacer 585 and bolt 570. Sleeve 545 has several mounting holes. The wider the spread between the holes used, the more movement there is to sign waving frame 400. Support bracket 540 is like drive bracket 530 except bracket 540 uses spacer 580 with bolt and lock nut 560 instead of coupler 590 with bolt 595. Support bracket 550 is identical to bracket 540 except for the sleeves. Bracket 550 uses sleeve 555 which has slits as the attachment points instead of the drilled holes in sleeve 545. Bracket 540 is in the basic embodiment while bracket 550 is optional. If desired, washers, extra spacers and longer bolts can be added to extend the widths of all brackets. All support brackets 540 and 550 are freewheeling and move in tandem with drive bracket 530. The drive and support brackets are all adjustable providing a wide variety of sign motions including a sideways swinging motion and a vertical rocking motion.

Connector bar 510 provides the connection points for brackets 540 and 550 and is attached to both sides of motor box 310 using bolts with lock nuts 520. From 1 to 5 support brackets can be used depending on the loads and envelope size of motor box assembly 300, sign waving frame 400 and its attached signs. This arrangement of support brackets and connector bars supports most of the combined weight of sign waving frame 400 and its attached signs. Being made from aluminum tubes, a typical sign waving frame 400 including bearings weighs about 15 pounds. Average sign weight is about 10 pounds. As a result, the overhung weight on drive bracket 530 and motor drive shaft 350 is minimal.

As shown in FIG. 9, sign waving frame 400 resembles a box-shaped truss structure that can stretch in all directions. The motor box assembly 300 in FIG. 8 attaches to sign waving frame 400 by inserting the drive and support brackets 530, 540 and 550 into bearings 955 which are part of bearing assemblies 950 that are attached to sign waving frame 400. As shown in FIG. 4, all bearing assemblies 950 can slide along insert tubes 650 during the attachment phase and then securely fastened using thumb screws 800. The number of support brackets and bearings used depends on the user application.

In a different embodiment, one or more sides of sign waving frame 400 can be welded as a single rigid structure replacing the adjustable telescoping version. In such an embodiment, tubes 650 would be inserted into bearing assemblies 950 prior to welding tubes 650 together. This will allow bearing assembly 950 to still slide along tubes 650 before fastening using thumbscrews 800 attached to bearing assembly 950. In a similar embodiment, one or more sides of sign waving frame 400 can be bolted together while still allowing bearing assembly 950 to slide. In another embodiment, a pin mechanism can be used in place of the bearing assembly 950. In other embodiments, a bent and shaped shaft can be used instead of drive bracket 530 and support brackets 540 and 550.

Included in the assembly of sign waving frame 400 are tubes 410 made from insert tube 650 that have drilled holes for fastening signs to frame 400 using bolt 420 and wing nut 430. In some embodiments, other attachment mechanisms could be used such as hook-and-loop fasteners and applying adhesive materials to multiple surfaces of the signs and sign waving frame 400.

Using connectors C, platform 100 can connect to a variety of customer furnished structures including posts, racks and mobile carts. Connectors C include zip ties, cables, rope, clips and other. Platform 100 is fastened only loosely at the top so it can freely swing in many directions with the wind W minimizing aerodynamic forces. All loads and forces on platform 100 are channeled through sign waving frame 400, motor box assembly 300, upper web 250 and spine 200. Platform 100 has a display capacity of about 300 pounds; 400 and more if reinforced components are used. In other embodiments, heavier hanging loads can be supported by using additional tubes and braces plus aluminum tubes with a thicker wall thickness.

The entire platform 100 plus attachments swing in unison like one large pendulum. Because spine 200 and motor box assembly 300 set inside sign waving frame 400, any signs attached to sign waving frame 400 may overlap any media hanging from upper web 250 without interfering in sign movement. This feature can provide a unique visual effect of overlapping dueling messaging.

Platform 100 has numerous configurations depending on the combination of joints, tube lengths plus telescoping. This structural versatility allows sign waving frame 400 to fit over and attach to other industry sign waving apparatuses to elevate them off the ground and switching them to a hanging mode that swings. Furthermore, using upper web 250, additional media and devices can be attached to complement the unique features of such competitive industry apparatuses.

Figure 10:
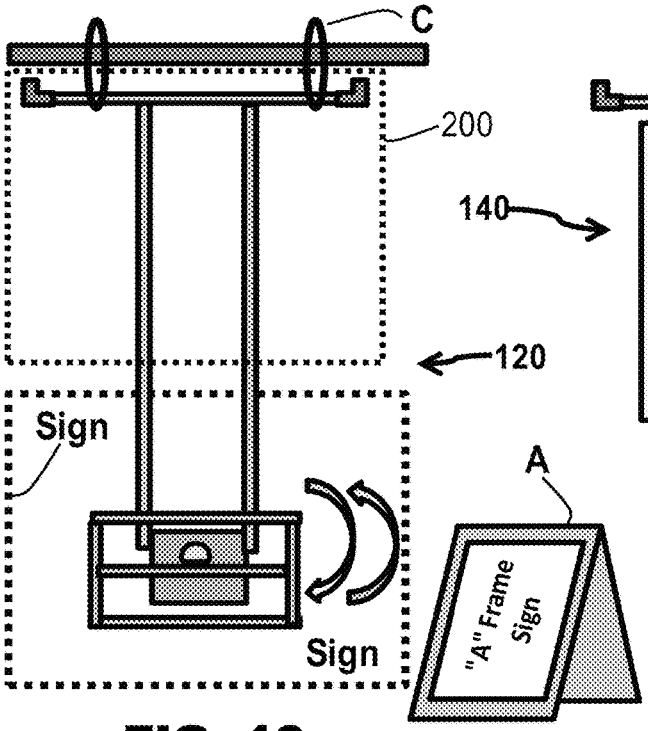
FIG. 10 illustrates one platform configuration using just the sign waving machine apparatus.
Figure 11:
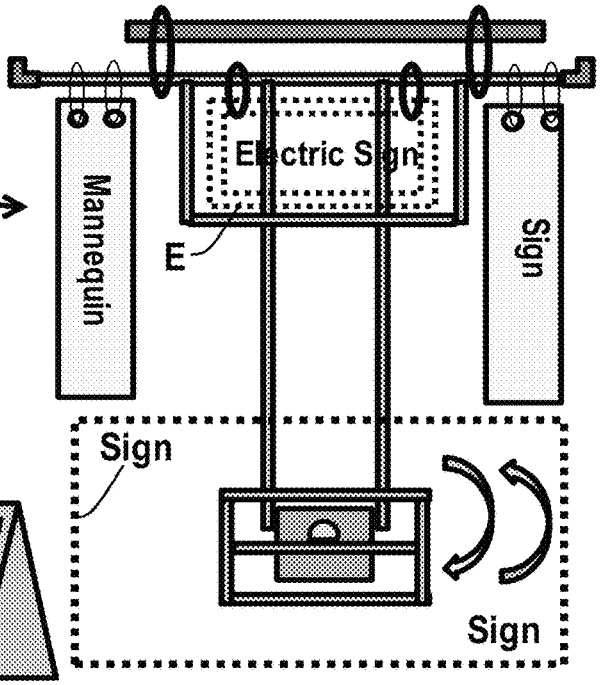
FIG. 11 illustrates one platform configuration using the sign waving machine apparatus along with a variety of media accessories attached to the upper web.
Figure 12:
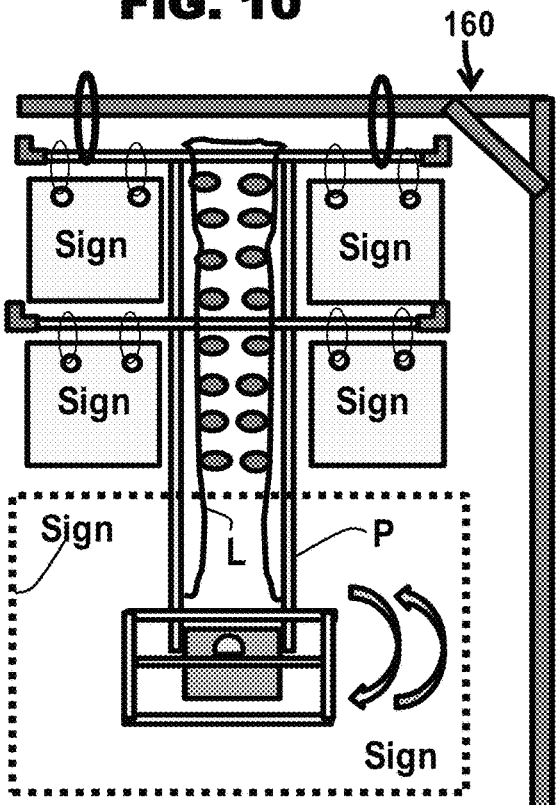
FIG. 12 illustrates one platform configuration which includes lights and is hung from a support frame anchored in the ground.
Figure 13:
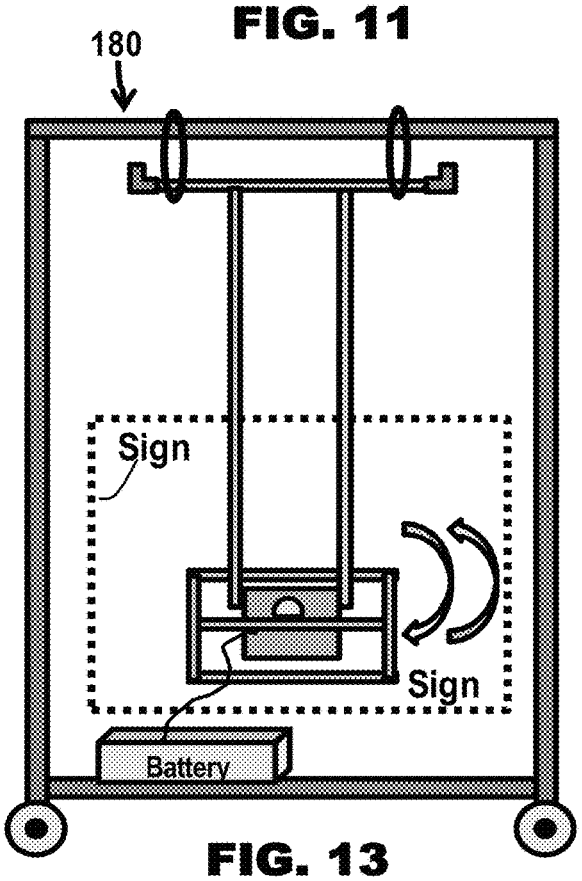
FIG. 13 illustrates one platform configuration which is hung from a customer furnished cart.

FIGS. 10-13 illustrate a variety of sign waving machine platform 100 configurations. FIG. 10 illustrates configuration 120 using just the sign waving machine apparatus attached to spine 200. It is attached to a user furnished post using connectors C. FIG. 11 illustrates configuration 140 that includes the sign waving machine apparatus complemented with a variety of media attached to upper web 250. FIG. 12 illustrates configuration 160 that is hung from a post embedded in the ground. Included are lights and/or light strings L wrapped around upper web 250 to illuminate platform 100. In another embodiment and as shown in FIG. 12, all of platform 100's components can be coated with a reflective paint P or powder coating where the reflection and bright colors can help to gain the attention of passersby. FIG. 13 illustrates configuration 180 where just the sign waving apparatus and spine is hung from a customer furnished cart.

The preferred material for any attached signs should be rigid, lightweight, and weather-proof such as corrugated plastic board. A reflective sign surface such as using reflective paint helps in gaining the attention of passersby. Platform 100 is of multi-piece construction with many common parts, resulting in lower manufacturing and storage cost. Further, providing platform 100 components in a compact customer kit to be assembled by a user may reduce shipping costs. Also, custom reader boards may be offered that include grommets for easy attachment to platform 100. These boards have grommets on all four corners so that they can be connected to other reader boards to increase overall sign size. All platform 100 components and reader boards nest well in the same shipping container that meets requirements for inexpensive air freight with home delivery.

It will be apparent to those skilled in the art that various changes in form and detail may be made to the present invention without departing from the spirit and scope of the invention. The present invention is intended to embrace all such alternatives, modifications and variances that fall within the scope of the appended claims.

I claim:

1. A sign waving machine platform that supports a sign waving apparatus plus other advertising media and which attaches to user furnished structures allowing the platform to freely swing with the platform comprising:

a spine constructed from telescoping aluminum tubes and structural brace members that loosely attaches at a top to user furnished posts, carts and so forth and which supports a sign waving apparatus;

a web constructed from telescoping aluminum tubes and structural brace members that can be attached to a top of the spine to provide additional mounting sites for electric signs, mannequins, flags and other signs;

a sign waving apparatus attached to a bottom of the spine that includes a motor housing, electric motor, sign frame, drive bracket, support brackets and bearing assemblies;

a motor housing attached to the bottom of the spine that encloses an electric motor that attaches to a drive bracket outside of the housing and wherein the motor's power wires are connected to a battery;

a adjustable sign frame constructed from telescoping aluminum tubes and structural brace members which surrounds the motor housing and wherein signs can be attached to all sides of the sign frame for viewing in several directions and wherein the sign frame can stretch or telescope to accommodate a variety of sign sizes and drive motor configurations;

a adjustable drive bracket that couples the motor drive shaft to a bearing assembly mounted on the sign frame wherein movement of the drive bracket causes movement of the sign frame relative to the motor housing;

a series of adjustable free swinging support brackets that connect both sides of the motor housing to bearing assemblies mounted on the sign frame and wherein these support brackets move in tandem with the drive bracket and support most of a combined weight of the sign frame and its attached signs; and a series of adjustable bearing assemblies and structural brace members mounted on the sign frame that connects the drive and support brackets to the sign frame and wherein these bearing assemblies can slide along the sign frame's tubing members to fine-tune connections before being securely fastened.

2. The sign waving machine platform of claim 1, wherein the sign frame can be adjusted to mount competitive sign waving apparatuses that generally sit on top of the ground and elevating them off the ground so that they can freely swing with wind.

3. The sign waving machine platform of claim 1, wherein pin mechanisms or other attachment mechanisms can be used instead of the bearing assemblies.

4. The sign waving machine platform of claim 1, wherein both the drive bracket and support brackets are all adjustable and have sets of drilled holes or slits for use in attachment and wherein the wider the distance between the holes or slits used, the more the sign movement providing a wide variety of sign motions including a sideways swinging motion and a vertical rocking motion.

5. The sign waving machine platform of claim 1 wherein the platform can be adapted or modified to be made from alternate materials including aluminum, plastics and composites and utilize alternate fastening mechanisms including thumb screws, snap buttons, and bolts with washers and nuts.

6. The sign waving machine platform of claim 1, wherein many of the structural brace members consist of a larger connecting aluminum host tube and 2 smaller aluminum insert tubes that slide inside and protrude at both ends of the host tube.

7. The sign waving machine platform of claim 6, wherein one or more sides of the sign frame can be optionally welded together while still allowing the bearing assemblies to slide along the insert tubes used in the sign frame structure.

8. The sign waving machine platform of claim 6, wherein one or more sides of the sign frame can be optionally bolted together while still allowing the bearing assemblies to slide along the insert tubes used in the sign frame structure.

9. The sign waving machine platform of claim 6, wherein the brace members are further comprised of a fastening mechanism consisting of thumb screws attached to both ends of the host tube and when twisted, press against and pinch the 2 smaller insert tubes to produce a snug, secure fasten.

10. The sign waving machine platform of claim 9 wherein the platform designed-in slop or space between the host and insert tubes so if any tubes become dirty or damaged, the insert tubes may still slide and be snuggly fastened using the thumb screws in claim 9.

11. The sign waving machine platform of claim 9, wherein the web can be optionally coupled to the spine using a variety of host tubes, insert tubes, connecting joints and thumb screws to provide numerous web configurations including multiple tiers and over hanging extension arms.

12. The sign waving machine platform of claim 9, wherein the bearing assemblies are constructed from the host tubes allowing the bearing assemblies to slide along the insert tubes used in the sign frame structure before being fastened to the sign frame using the thumb screws attached to the bearing assembly's host tubes.

13. The sign waving machine platform of claim 9, wherein all joints are made from the same larger host tube and wherein thumb screws attached to the joint's branches that when twisted, press against and pinch the smaller insert tubes including those protruding from the brace members.

14. The sign waving machine platform of claim 13, wherein all the joints allow the attached brace members and insert tubes to slide inside the joints for easy attachment, adjustment and fastening using the joint's thumb screws.

15. The sign waving machine platform of claim 13, wherein the spine is comprised of two parallel brace members that are interconnected using the joints and wherein the lower end of the spine is attached to both sides of the motor housing with the upper ends of the spine and web are loosely fastened to user-furnished posts, carts and so forth using a variety of store bought connectors including zip-ties and rope providing a capability to freely swing in many directions as a single unit to minimize the effect of aerodynamic and other forces.

16. The sign waving machine platform of claim 15, wherein a hinge joint is optionally used instead of a store bought connectors to couple the spine and web to user furnished structures wherein this hinge arrangement limits swinging of the entire platform to one back and forth direction only.

17. The sign waving machine platform of claim 9, wherein the brace members can telescope or stretch up to a point where markings embedded onto the insert tubes have become visible and wherein if stretched beyond the markings, the insert tubes may have slid too far and the thumb screws may miss pinching the insert tubes.

18. The sign waving machine platform of claim 17, wherein the overall length of the brace members can be changed by coupling additional host and insert tubes to the brace members.

19. The sign waving machine platform of claim 17, wherein the overall length of the brace members can be further changed by providing tubes of different lengths.

20. The sign waving machine platform of claim 19, wherein combining the telescoping capabilities with the additional tubes and with using the multiple tube lengths, together provides an extensive range of platform configurations for supporting a wide assortment of signs, indicia bearing media and advertising devices including multiple sided versions for viewing in several directions.

* * * * *